United States Patent [19]

Batchelor

[11] Patent Number: 4,889,238

[45] Date of Patent: Dec. 26, 1989

[54] MEDICAMENT PACKAGE FOR INCREASING COMPLIANCE WITH COMPLEX THERAPEUTIC REGIMENS

[75] Inventor: Jay A. Batchelor, Norwich, N.Y.

[73] Assignee: The Procter & Gamble Company, Cincinnati, Ohio

[21] Appl. No.: 332,687

[22] Filed: Apr. 3, 1989

[51] Int. Cl.[4] ..... B65D 83/04

[52] U.S. Cl. ..... 206/535; 206/534; 206/828; 206/232

[58] Field of Search ..... 206/528, 531, 532, 534, 206/535, 536

[56] References Cited

U.S. PATENT DOCUMENTS

| | | | |
|---|---|---|---|
| 625,757 | 5/1899 | Groneman | 206/535 X |
| 3,302,776 | 2/1967 | Sparks | 206/535 X |
| 3,743,084 | 7/1973 | Douglas | 206/532 X |
| 4,340,141 | 7/1982 | Fischer | 206/531 |

*Primary Examiner*—William Price

*Attorney, Agent, or Firm*—R. C. Witte; J. V. Gorman; M. E. Hilton

[57] ABSTRACT

A medicament package for improving compliance with a therapeutic regimen. The therapeutic regimen involves a plurality of medications administered to a patient in a prescribed sequence and in accordance with specified intervals. The package includes a multiplicity of blister cards of generally uniform planar dimensions. The blister cards carrying the medicaments in sequential order on the individual cards and from card to card. The blister cards being placed in stacked array with the principal dimensions thereof oriented generally horizontally and arranged in order of use with the first to be used topmost. Also included is a base which houses the stack of blister cards and is adapted to support the stack vertically and provides lateral support to the edges of the blister cards. The base permits direct and unobstructed access to the uppermost blister card and limited access only to the edges of the blister cards. A lid is adapted to cover the base and movable to an open position allowing access to the uppermost blister card. Each blister card generally contains indicia denoting the order and sequence when the contents of a particular blister cavity are to be consumed.

8 Claims, 6 Drawing Sheets

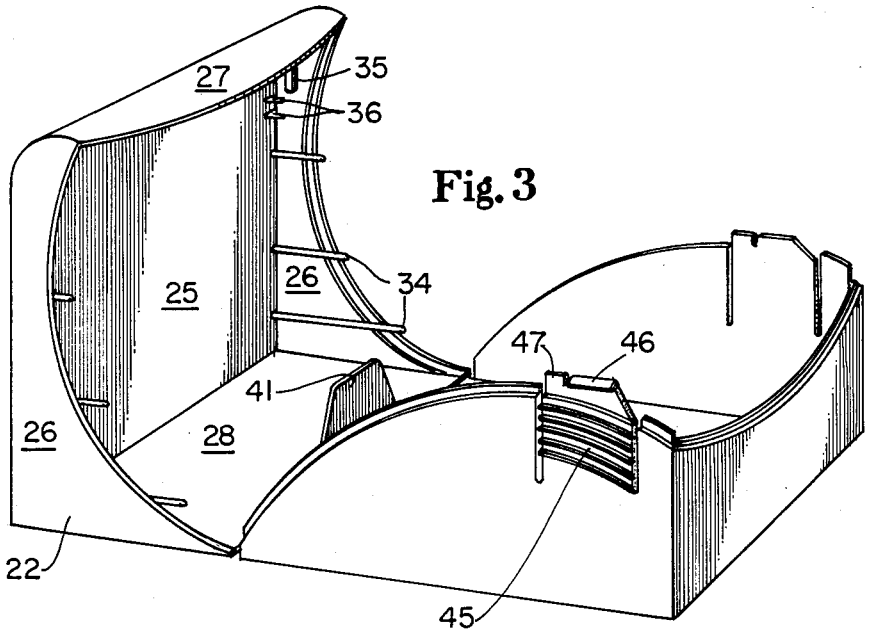
Fig. 3
Fig.4
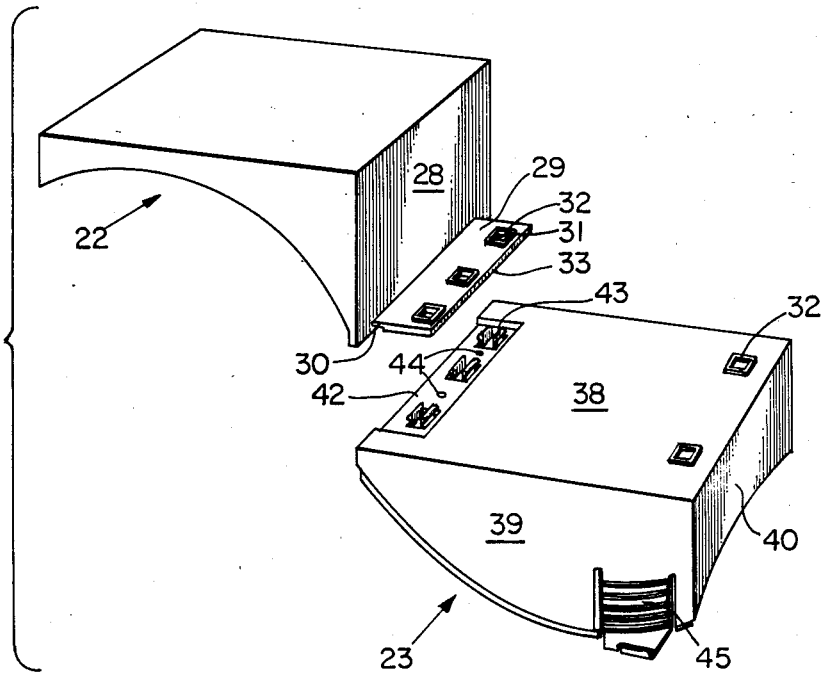

MEDICAMENT PACKAGE FOR INCREASING COMPLIANCE WITH COMPLEX THERAPEUTIC REGIMENS

BACKGROUND OF THE INVENTION

1. Field of the Invention

The present invention relates to containers for storing blister cards containing medicaments and more particularly, for storing such blister cards to increase compliance and monitoring of long, complex therapeutic regimens.

2. Description of Prior Art

Treatment for certain medical disorders can involve a complex therapeutic regimen where the patient is required to take certain medications on certain days. Since the patient is required to take a particular medication at a particular point in the regimen and other medications at other times, the complexity of these regimens results in low overall compliance. Many blister cards have been developed which include indicia indicating at what time a particular medication is to be taken.

Leonard et al, U.S. Pat. No. 4,736,849, discloses a blister card folded in-half containing one complete cycle of several medications to be taken over a one month period. Imprinted on the blister card is indicia which relates each pill or group of pills to a particular day of the month. The blister card is folded in half in order to reduce its dimensions.

U.S. Pat. No. 4,295,567, to Knudsen, discloses a blister card housing two separate medicaments with indicia denoting that one type of medicament is to be taken during the day and the other medicament is to be taken at night. The blister card contains five full cycles; one cycle for each of five days.

The effectiveness of these blister cards are limited by the practical physical limitations on the dimensions of each card. Problems arise when a complete cycle of treatment cannot be conveniently placed entirely on one card.

When dealing with multiple cards it is entirely possible that at some point in the treatment, particularly if the treatment is lengthy, confusion will result and the wrong card will be pulled from the container. Consequently, the patient may take the wrong medication at the wrong time. To avoid this, it is desirable to provide a container for the blister cards which eliminates, or substantially reduces the likelihood of confusion.

It is an object of the invention to provide multiple medications to the patient for complex therapeutic regimens which increases compliance.

It is further an object of the invention is to provide a container for housing several blister cards.

It is likewise an object of the invention to provide a container which houses the blister cards in such a manner that only the card currently being used is exposed for removal.

It is also an object of the invention to provide a container which prevents shifting of the remaining cards during the interval while the current blister card is removed.

It is further an object of the invention that the current card cannot be reinserted other than in its proper order.

It is additionally an object of the invention to provide a means to monitor compliance which can easily be taken to the doctor.

SUMMARY OF THE INVENTION

In accordance with one aspect of the present invention there is provided a package for improving compliance with a therapeutic regimen. The regimen involves a plurality of medicaments to be administered to a patient in a prescribed sequence and at specified intervals. The package includes a multiplicity of blister cards having generally uniform planar dimensions. These blister cards carry the medicaments in sequential order on the individual cards and from card-to-card. The blister cards are placed in stacked array with the principal dimensions thereof oriented generally horizontally and arranged in order of card use with the first to be used topmost. Also included in the package is a base which houses the stack of blister cards. The base is adapted to support the stack vertically and has means to provide lateral support to maintain vertical alignment of the edges of the blister cards. The base permits direct and unobstructed access to the uppermost blister card of the stack and limited access only to the edges of the blister cards. Additionally, a lid is adapted to cover the base and moveable to an open position whereby access to said uppermost blister card is provided.

BRIEF DESCRIPTION OF THE DRAWINGS

FIG. 3 is a perspective view of the preferred embodiment of the box in the fully opened position.

FIG. 4 is an exploded perspective view of the base and lid of the preferred embodiment.

DESCRIPTION OF THE PREFERRED EMBODIMENTS

The present invention provides a device for providing complex therapeutic regimens to patients in such a manner that overall compliance is increased.

Figure 1:
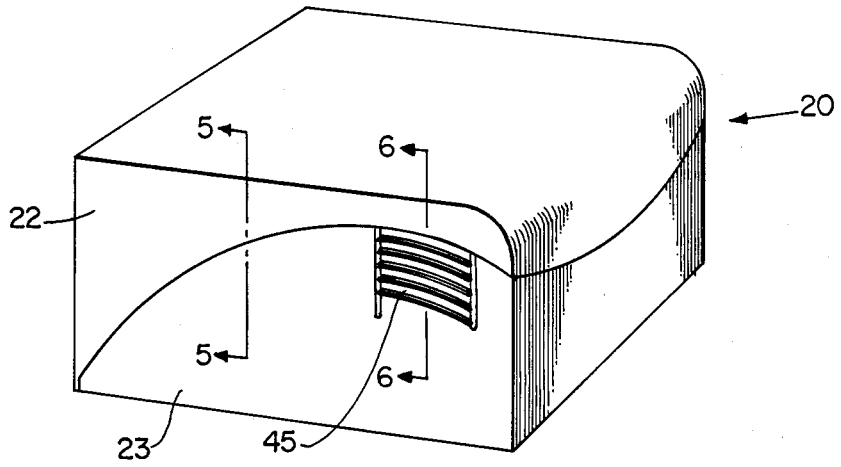
FIG. 1 is a perspective view of the preferred embodiment of the box in the closed position.

Referring to FIG. 1, the box 20 comprises a lid 22 and a base 23, and is sized to fit nicely into a medicine cabinet. The box 20 can have dimensions of approximately 14 cm X 12 cm X 7 cm and wall thicknesses of approximately 2.5 mm. In the closed position, all surfaces of the box 20 are flush making it easy to store in any orientation. More importantly, no edges are provided for a child to use in attempting to pry open the box 20.

Figure 6:
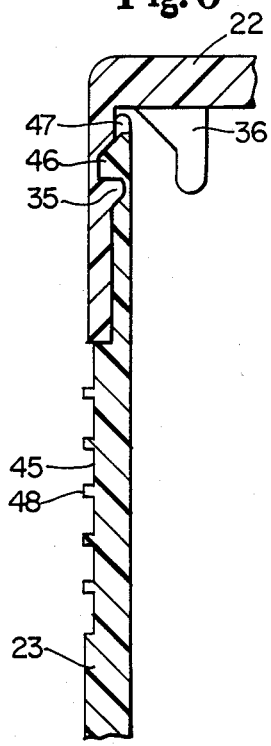
FIG. 6 is an enlarged cross-sectional detail view of the latch taken along line 6—6 of FIG. 1 showing the latch in the locked position.

Referring to FIG. 3, the lid 22 can be injection molded and is preferably made out of materials such as polypropylene, polypropylene copolymer or high density polyethylene. The lid 22 is defined by a top 25 two sides 26, a front 27, and a back 28. Referring to FIG. 4, a flap 29 is connected to the back 28 by a living hinge 30. Located on the flap 29 are three interlock receptacles 31 which extend through raised feet 32. Two alignment pins 33 project outwardly from the base-contacting side of flap 29. As seen in FIG. 3, guide posts 34 are located along the interior of the sides 26 of the lid 22 and extend somewhat past their free edges. As seen in FIG. 6, a cooperating latching element 35 is located on the interior of each side 26 of the lid 22. Ramps 36 are located on the interior of the top 25 of the lid 22 and are contoured toward the side 26.

With continuing reference to FIG. 4, the base 23 can be injection molded and is preferably made out of materials such as polystyrene, acrylonitrile-butadiene-styrene (ABS) copolymer, polypropylene copolymer, PVC, cellulose butyrate, cellulose propionate or a butadienestyrene such as K-resin KROl. The base 23 is defined by a bottom 38, two sides 39, a front 40 and, as seen in FIG. 3, an interior back wall 41. The interior back wall 41 is a partial wall constructed at a slight inward angle so that it does not interfere with the back wall 28 of the lid 22 upon closure. There is a recess 42 along the rear edge of the underside of the bottom 38 wherein three interlock snaps 43 and two alignment holes 44 are provided. Each of the two sides 39 of the base 23 has an integral, cantilevered latch 45 formed therein. As seen in detail in FIG. 6, these latches 45 include the latching element 46 and a ramp button 47. Additionally, the exterior surfaces of the latches 45 have designs raised in relief thereon with the tops of the raised portions 48 flush with the outer exterior surfaces of sides 39 of the base 23. Consequently, the latches 45 may be readily located either visually or by touch.

Figure 9:
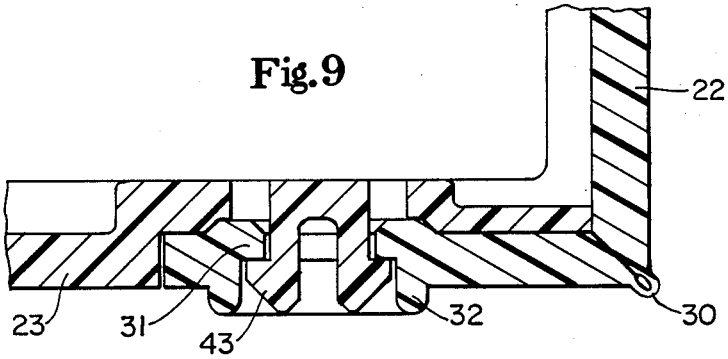
FIG. 9 is an enlarged cross-sectional view illustrating the interlocking connection of the lid to the base.

To assemble the box 20 the base 23 and lid 22 are oriented as shown in FIG. 4 and joined by aligning and inserting the interlock snaps 43 into the interlock receptacles 31 and pressing the parts together. The interlock arrangement is best seen in FIG. 9. This process is aided by the alignment pins 33 and alignment holes 44 which also prevent subsequent lateral movement of the flap 29 relative the base 23. Two feet 32 molded on the underside of bottom 38 adjacent its front edge, raise the base to the same extent as the feet 32 surrounding the interlock receptacles 31 and enable the box 20 to sit level when assembled.

Figure 5:
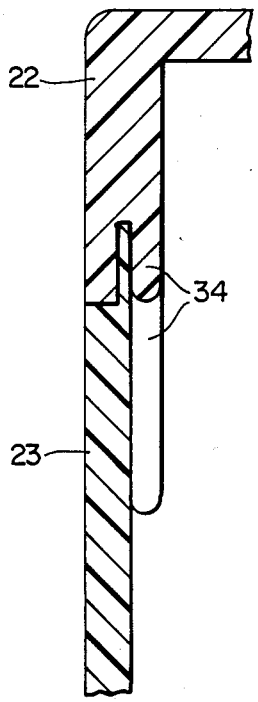
FIG. 5 is an enlarged cross-sectional detail view taken along line 5—5 of FIG. 1 showing the joints between the base and lid when the box is closed.

As noted earlier, when assembled and closed all joints on the box 20 are flush. The flap 29 sits in the recess 42 such that it is flush with the bottom 38 of base 23. In addition, FIG. 5 illustrates that the face edges of the sides 39 and 26 of both the base 23 and the lid 22, respectively, are rabbeted to create half lap joints upon closure of the box 20. Therefore, if pressure is exerted on the sides and not the latches 45 the box 20 resists opening. Likewise, if only one latch 45 is depressed, the box 20 resists opening. Continued engagement of the second latch, the reinforcement provided by the guide posts 34 and the rabbeted edges helps prevent the lid 22 from being twisted or levered open. Preferably, the lid 22 is sufficiently resistant to twisting that pressing inwardly on only one latch 45 will not permit the latch 45 to remain unlatched or the lid 22 to remain open after the latch 45 is released.

Figure 2:
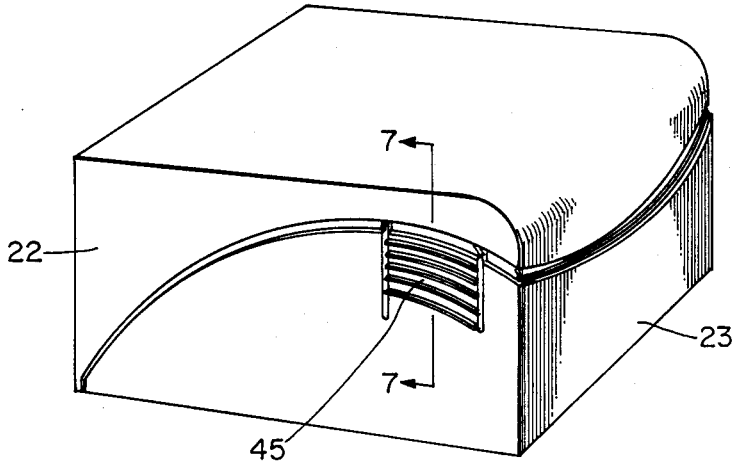
FIG. 2 is a perspective view of the preferred embodiment of the box in the partially opened position.
Figure 7:
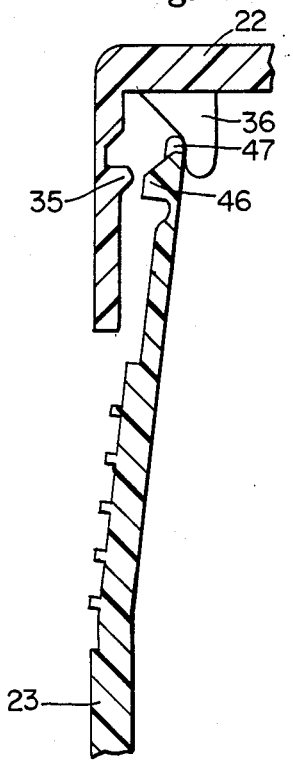
FIG. 7 is an enlarged cross-sectional detail view of the latch taken along line 7—7 of FIG. 2 showing the latch in its depressed position.
Figure 8:
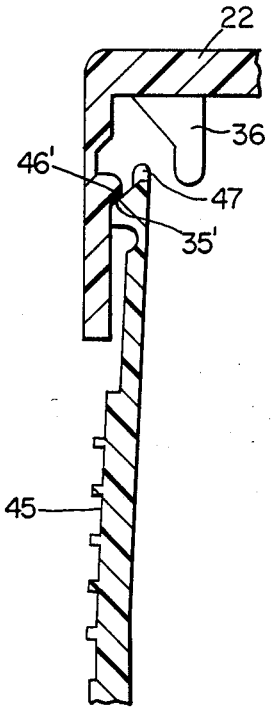
FIG. 8 is an enlarged cross-sectional detail view of the latch supporting the lid in the partially open position and taken along line 7—7 of FIG. 2.

FIG. 1 shows the box 20 in a closed position and FIG. 6 shows the latching element 46 of the latch 45 engaging the cooperating latching element 35 of the lid 22. To open the box 20 the latches 45, which are placed inconspicuously on opposite sides 39 of base 23, are located and simultaneously depressed using equal and opposing forces. Since both latches 45 are not visible at the same time, it is not apparent to children that they are related. Simultaneous depression of the latches 45 disengages the latching element 46 from the cooperating latching element 35 on the lid 22. In addition, as seen in FIG. 7, the ramp buttons 47 of each latch 45 exerts camming pressure on the ramps 36 to lift the lid 22. Thus, the box 20 is automatically partially opened upon the simultaneous pressing of the latches 45. The mechanism for automatically partially opening the box 20 could also be provided by other means, such as a spring (not shown). This partially open position seen in FIG. 2 is maintained by the latches 45 as is seen in FIG. 8. As the latches are released, the upper surface 46', of the latching element 46 of each latch 45 rests against the lower surface 35' of the cooperating latching element 35. Once this static position is reached, a second motion is needed to rotate the lid 22 to the fully open position shown in FIG. 3 and to expose the contents of the box 20. To close the box 20 the lid 22 is rotated to the closed position of FIG. 1. As the lid 22 is latched an audible sound is heard which assures the box 20 is closed and again child resistant.

This child resistant box 20 is particularly well suited for housing complex therapeutic regimens. A complex therapeutic regimen is one that involves the taking of various medicaments throughout the regimen. In other words, a particular medicament will be taken on a particular day or at a particular time of day while different medications are taken at different times during the therapeutic regimen.

Figure 10:
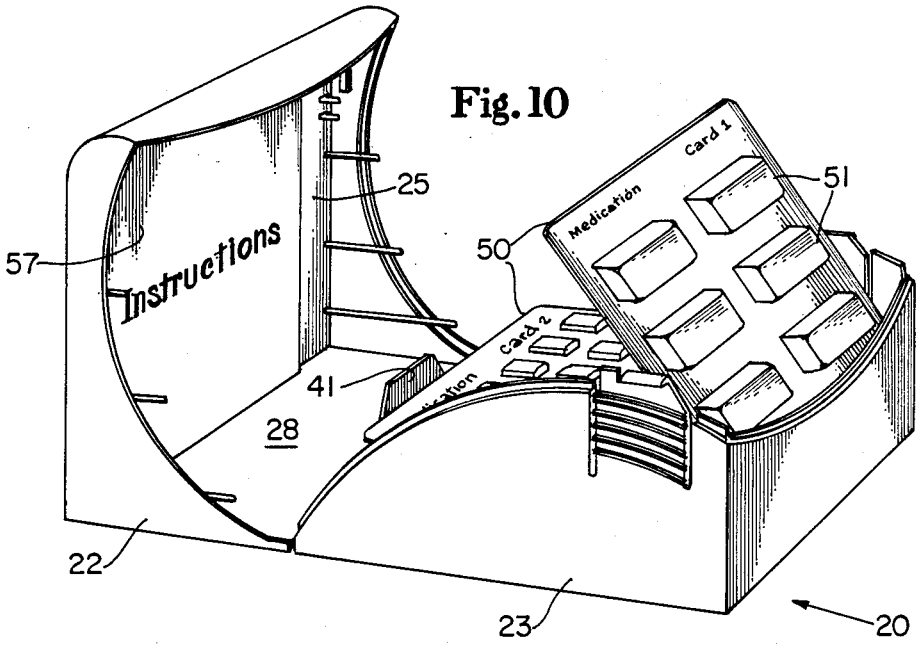
FIG. 10 is a perspective view of the preferred embodiment of the box in an open position and filled with blister cards.

Referring to FIG. 10, the box 20 of the preferred embodiment accommodates a therapeutic regimen which involves taking two or three different medicament products at different doses and time intervals over a ninety day cycle. The overall therapy may consist of several ninety day cycles over a period of three or more years. To better insure compliance the medicaments are presented in blister card form. Since it is not feasible to put a complete ninety day cycle on one blister card, it is necessary to have multiple blister cards 50. These blister cards 50 must be maintained in the appropriate order of use to insure that each medicament is taken at the appropriate point in the regimen. The box 20, in coordination with the blister cards 50 achieves this goal.

The box 20 is designed to hold the blister cards 50 in a horizontal orientation. The blister cards 50 have planar dimensions which are substantially equal to the horizontal planar dimensions of the base 23 of the box 20. The blister cards 50 are superposed one on another in stacked array in order of use with Card 1 on top, and descending in order, with the last blister card 50 on the bottom. Finger access to the edge of the top blister card 50 is achieved by reaching between the interior back wall 41 and the side 39, and grasping the edge of the top blister card 50, to pull it out. Alternatively, finger access could be achieved by notching the blister cards 50 to allow the insertion of a finger (not shown).

The horizontal orientation of the blister cards 50 require that the top blister card 50 be pulled out first. The blister card 50 must be returned to the top of the stack because it cannot be slipped between other blister cards 50 in the stack since the interior back wall 41 is in the way. When the exposed blister card 50 is empty, it is thrown away and the next blister card 50 is exposed. Also, the design of the box 20 prevents the blister cards 50 from being put back in the wrong order. For example, if the blister cards 50 were oriented vertically, it would be easy to return one blister card 50 between the others in the box 20 in the wrong order. This is especially likely where removal of a blister card 50 causes one or more of the remaining blister cards 50 to fall forward.

Figure 11:
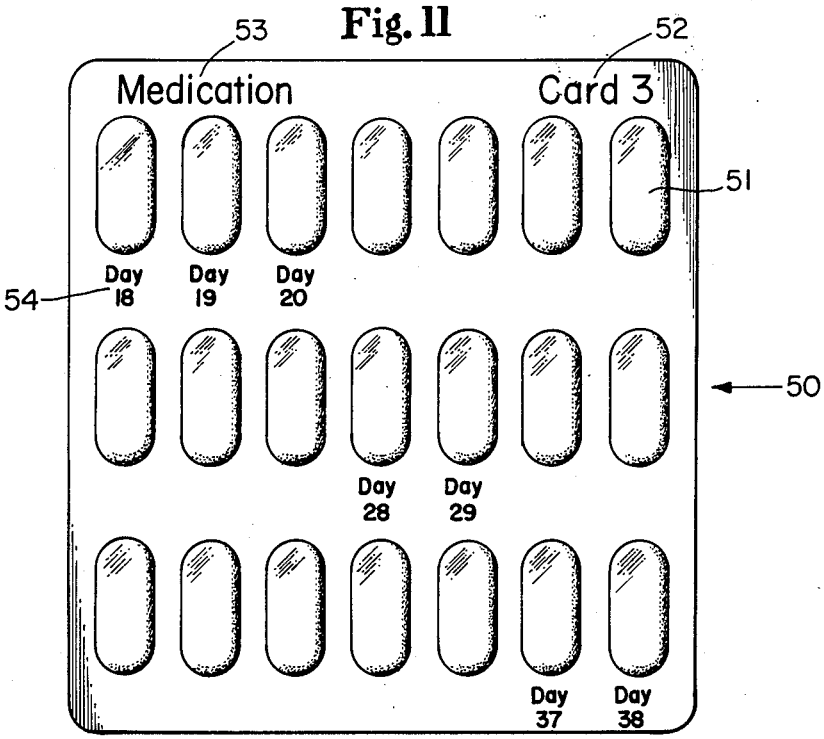
FIG. 11 is a plan view of the front of a blister card.
Figure 12:
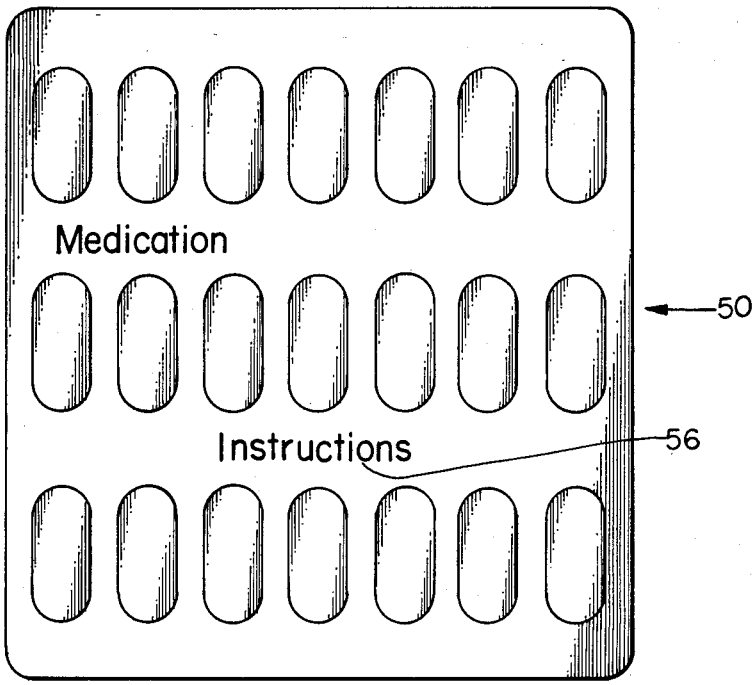
FIG. 12 is a plan view of the back of the blister card of FIG. 11.

Each of the medicaments contained within the cavities 51 of the blister cards 50 are color coded. The medicaments are packaged in blister cards 50, the general structure of which are well known in the art. These can comprise a clear film layer containing blister cavities 51 heat-sealed to a foil layer which includes indicia on both sides. As illustrated in FIGS. 11 and 12, each blister card is printed with the following information: a card number 52, indicating the relative order of use in the treatment; the product name 53 indicating the medicament housed on the blister card 50; a day number 54 associated with each blister cavity 51 indicating the day of treatment that medicament is to be taken; the time of day associated with each blister cavity where applicable; and the dosing instructions 56.

The blister cards 50 of the preferred embodiment contain one medicament per blister card 50. Each blister card 50 is designed such that one cavity 51 represents one dose. Therefore, if two or more units of a medicament are required per dose, these units will share the same cavity 51.

In addition to containment of the blister cards 50, this box 20 includes other features which contribute to increased overall patient compliance. Referring to FIG. 10, the lid 22, when open, sits on its back 28 such that the top 25 of the lid 22 is perpendicular to the bottom 38 of the base 23 containing the blister cards 50. This provides a display panel on the interior of the top 25 on which a label 57 is placed. This label 57, with medicament color coding, provides complete instructions for the full ninety day cycle so that the patient is able to see the therapeutic regimen at a glance and does not have to pull out or shuffle through all of the blister cards 50. This eliminates the potential that the blister cards 50 could get out of order while they are out of the box 20, or that they could be put back incorrectly.

Figure 13:
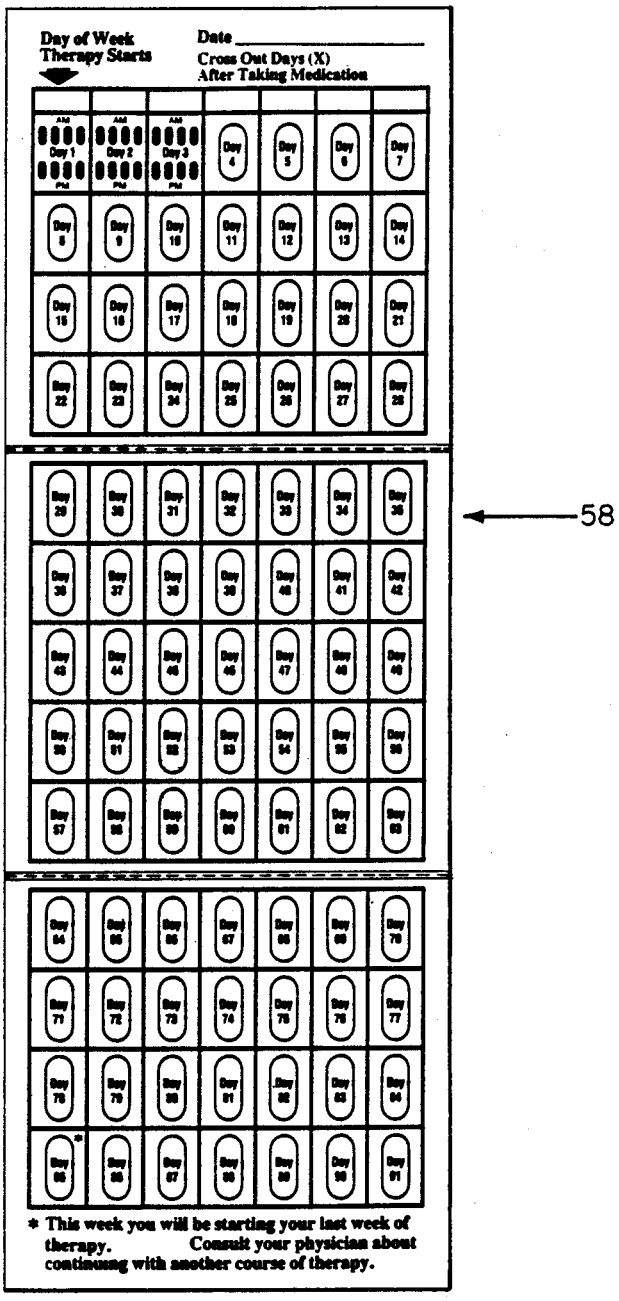
FIG. 13 is a plan view of a calendar used for coordinating the day of treatment with the month and day of the year.

The fold-out calendar 58 insert of FIG. 13 is designed to be folded and placed on top of the blister cards 50 inside the box 20. This calendar 58 provides a visual and verbal description, using similar product color coding, of what medicaments are to be taken on what days. The patient may cross out each calendar day after taking the correct dose. The calendar 58 prevents confusion if the patient has difficulty remembering whether or not a day's dose was taken. The pharmacist or patient fills in the day and month of day 1 in the cycle. He also fills in the days of the week at the top of the calendar. This allows the patient to coordinate the day of the treatment with the day and month of the year so that he may confirm whether the blister cavity 51 associated with the day number on the blister cards 50 is empty. If the cavity corresponding to that date is empty then the patient has already taken the medicaments for that day. The calendar 58 will also remind the patient, prior to completion of the ninety day cycle when it is time to schedule another visit to the doctor. This calendar 58 is taken to the doctor at the time of the visit to confirm the level of compliance with the regimen.

A patient information booklet, not shown, can also be included as an insert. The booklet can explain, for example, the therapeutic regimen, how it relates to the disease and the dosing information for the therapy cycle.

In summary, the box 20 operation and its use during the therapeutic regimen goes as follows:

With the box 20 in a closed position as seen in FIG. 1 the user takes both hands, and simultaneously presses the two latches 45 on the sides 39 with equal and opposing forces. The combined action of the ramp buttons 47 on the ramps 36, causes the lid 22 to release with a slight pop pp action to partially open position as shown in FIG. 2. Then, in a second motion the lid 22 is rotated until it sits on its back 28.

The interior label 57 on the lid 22 is visible. This gives the dosing regimen for the complete ninety day cycle of therapy. The patient information booklet and the calendar 58 which has been dated are laying on top of the blister cards 50. These inserts may be removed to expose the top blister card 50, Card 1. This blister card 50 is removed by reaching between the sides 39 and the interior back wall 41, grasping the edge of the top blister card 50 and pulling it out as seen in FIG. 10. Once the desired dose is obtained from the blister card 50 the blister card 50 is returned to the box 20 face up in its horizontal position. To close the box 20 the lid 22 is rotated to the closed position and, as the latches 45 interlock, an audible click is heard which assures the user the box 20 is completely closed and returned to its FIG. 1 status.

As each blister card 50 is emptied, it is thrown away leaving the next, subjacent, blister card 50 exposed. As each dose is taken the patient crosses out the day number on the calendar 58. When the cycle is almost finished, the calendar 58 and the last blister card 50, remind the patient to schedule the next doctor's appointment so that a new cycle may be obtained if necessary. The patient also takes the calendar 58 to the doctor's office on the day of the visit so that the doctor may review the patient's compliance and progress. A new cycle of the therapeutic regimen may be prescribed and the patient would then receive blister cards 50 with a ninety day supply of medicaments. If so, a new calendar 58 would be inserted into the box 20.

It is, of course, to be understood that the present invention is by no means limited to the particular arrangement shown in the drawings, it also comprises applications within the scope of the appended claims.

What I claim is:

1. A medicament package for improving compliance with a therapeutic regimen wherein a plurality of medicaments are to be administered to a patient in a prescribed sequence and in accordance with specified intervals, said package comprising:

(a) a multiplicity of blister cards of generally uniform planar dimensions, said medicaments being carried by said blister cards in sequential order on the individual cards and from card-to-card, said blister cards being placed in stacked array with the principal dimensions thereof oriented generally horizontally and arranged in order of card use, with the first to be used topmost;

(b) a base which houses the stack of blister cards, said base being adapted to support said stack vertically and having means therein to provide lateral support to maintain vertical alignment of the edges of the blister cards comprising the stack, said base permitting direct and unobstructed access to the uppermost blister card of the stack and limited access, only, to the edges of said blister cards; and (c) a lid adapted to cover said base and movable to an open position whereby access to said uppermost blister card is provided.

2. A package according to claim 1 wherein said limited access to the edge of said blister cards is provided by a partial internal back wall projecting from said base.

3. A package according to claim 1, wherein said blister card has indicia located thereon which includes a card number denoting the order of use and correct location of each card within said stacked array.

4. A package according to claim 1, wherein said limited access to the edge of said blister cards is provided by a partial internal back wall projecting from said base and said blister card has indicia located thereon, which includes a card number denoting the order of use and correct location of each card within said stacked array.

5. A package according to claim 3, or claim 4, wherein said indicia includes consecutive integer numbers associated with each blister cavity denoting the day of the treatment in which said medicaments in said blister cavity are to be consumed.

6. A package according to claim 5, wherein said therapeutic regimen is for a period greater than about one month.

7. A package according to claim 5 further comprising a calendar for coordinating the day of the treatment with the month and day of the year.

8. A package according to claim 5, wherein all of said medicaments contained on a single blister card are identical and said indicia also denotes the name of said medicaments.

* * * * *